US011733634B2

(12) United States Patent
Kobayashi et al.

(10) Patent No.: US 11,733,634 B2
(45) Date of Patent: Aug. 22, 2023

(54) IMAGE FORMATION APPARATUS INCLUDING ANGLED SEPARATION MEMBER

(71) Applicant: Oki Electric Industry Co., Ltd., Tokyo (JP)

(72) Inventors: Takashi Kobayashi, Tokyo (JP); Toshiyuki Kimura, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/370,789

(22) Filed: Jul. 8, 2021

(65) Prior Publication Data

US 2022/0026840 A1 Jan. 27, 2022

(30) Foreign Application Priority Data

Jul. 27, 2020 (JP) ..... 2020-126100

(51) Int. Cl.
*G03G 15/00* (2006.01)

(52) U.S. Cl.
CPC . *G03G 15/657* (2013.01); *G03G 2215/00413* (2013.01); *G03G 2215/00675* (2013.01)

(58) Field of Classification Search
CPC ..... G03G 15/657; G03G 2215/00413; G03G 2215/00675
See application file for complete search history.

(56) References Cited

U.S. PATENT DOCUMENTS 4,369,729 A * 1/1983 Shigenobu ..... G03G 15/657 430/124.23
4,636,057 A * 1/1987 Iida ..... G03G 15/605 355/75
4,887,101 A * 12/1989 Hirose ..... G03G 15/70 347/153
8,135,319 B2 * 3/2012 Fujita ..... G03G 15/657 399/361
9,665,054 B2 * 5/2017 Ishida ..... G03G 15/6529
2009/0297242 A1 * 12/2009 Kanematsu ..... G03G 15/657 399/400

FOREIGN PATENT DOCUMENTS

JP 2011-7921 A 1/2011
JP 2011007921 A * 1/2011

* cited by examiner

*Primary Examiner* — Justin N Olamit
(74) *Attorney, Agent, or Firm* — Metrolex IP Law Group, PLLC

(57) ABSTRACT

An image formation apparatus according to an embodiment may include: an image carrier; a transfer part facing the image carrier; a transfer belt that passes between the image carrier and the transfer part, includes a conveyance surface, and configured to convey a medium on the conveyance surface; plural rollers to which the transfer belt is stretched, the plural rollers including a downstream roller provided on a downstream side in the medium conveyance direction among the plural rollers; and a separating member facing the downstream roller and configured to separate the medium from the transfer belt. The separating member includes a guide surface to guide the medium, wherein the guide surface is arranged at an angle such that a distance from the guide surface to a conveyance reference plane becomes shorter as proceeding in the medium conveyance direction, the conveyance reference plane being a virtual plane extending the conveyance surface.

7 Claims, 11 Drawing Sheets

FIG. 10A
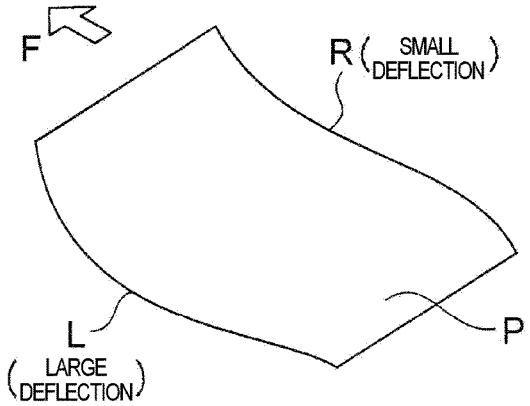
FIG. 10B
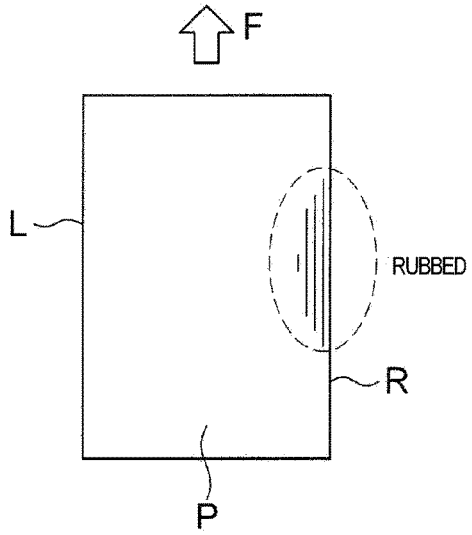
FIG. 11
| MEDIUM | | BLURRING RATE (%) | | | | | |
|---|---|---|---|---|---|---|---|
| | | NN | | LL | | HH | |
| TYPE | BASIS WEIGHT ($g/m^2$) | COMPARISON EXAMPLE | EMBODIMENT | COMPARISON EXAMPLE | EMBODIMENT | COMPARISON EXAMPLE | EMBODIMENT |
| P 1 | 60 | 64.7 | 0.0 | 27.7 | 0.0 | 44.3 | 0.0 |
| P 2 | 90 | 0.0 | 0.0 | 0.0 | 0.0 | 0.0 | 0.0 |

IMAGE FORMATION APPARATUS INCLUDING ANGLED SEPARATION MEMBER

CROSS REFERENCE TO RELATED APPLICATIONS

This application claims priority based on 35 USC 119 from prior Japanese Patent Application No. 2020-126100 filed on Jul. 27, 2020, entitled "IMAGE FORMATION APPARATUS", the entire contents of which are incorporated herein by reference.

BACKGROUND

The disclosure may relate to an image formation apparatus configured to transfer and fix a developer image to a medium.

In a related art, an image formation apparatus includes a transfer unit configured to transfer a developer image to a medium, and a fixation unit configured to fix the developer image to the medium. A guide member is provided between the transfer unit and the fixation unit to guide the medium to the fixation unit (see, for example, Patent Document 1: Japanese Patent Application Publication No. 2011-7921 (see FIG. 2))

SUMMARY

However, when the medium reaches the fixation unit, torsion (or twisting) of the medium may occur, in which the amount of deflection differs at both widthwise ends of the medium. If fixation is performed in such a state, printing defects such as blurring may occur.

An object of an embodiment of the disclosure may be to suppress torsion of a medium.

An aspect of the disclosure may be an image formation apparatus that may include: an image carrier configured to carry a developer image; a transfer part arranged facing the image carrier; a transfer belt that passes between the image carrier and the transfer part, includes a conveyance surface that is a plane facing the image carrier, and configured to convey a medium on the conveyance surface; a plurality of rollers to which the transfer belt is stretched, the plurality of rollers including a downstream roller provided on a downstream side in the medium conveyance direction among the plurality of rollers; and a separating member provided facing the downstream roller and configured to separate the medium from the transfer belt. The separating member includes a guide surface to guide the medium, wherein the guide surface is arranged at an angle such that a distance from the guide surface to a conveyance reference plane becomes shorter as proceeding in the medium conveyance direction, the conveyance reference plane being a virtual plane extending the conveyance surface.

According to the aspect described above, the medium is guided by the guide surface, which reduces the difference in the amount of deflection between both widthwise ends of the medium and suppresses torsion of the medium. As a result, the occurrence of printing defects such as blurring can be suppressed.

BRIEF DESCRIPTION OF DRAWINGS

FIGS. 10A and 10B are diagrams illustrating schematic views for explaining torsion of the medium and blurring on the medium according to a comparative example;

FIG. 11 is a table illustrating a comparison of blurring rates between an embodiment and a comparative example.

DETAILED DESCRIPTION

Figure 1:
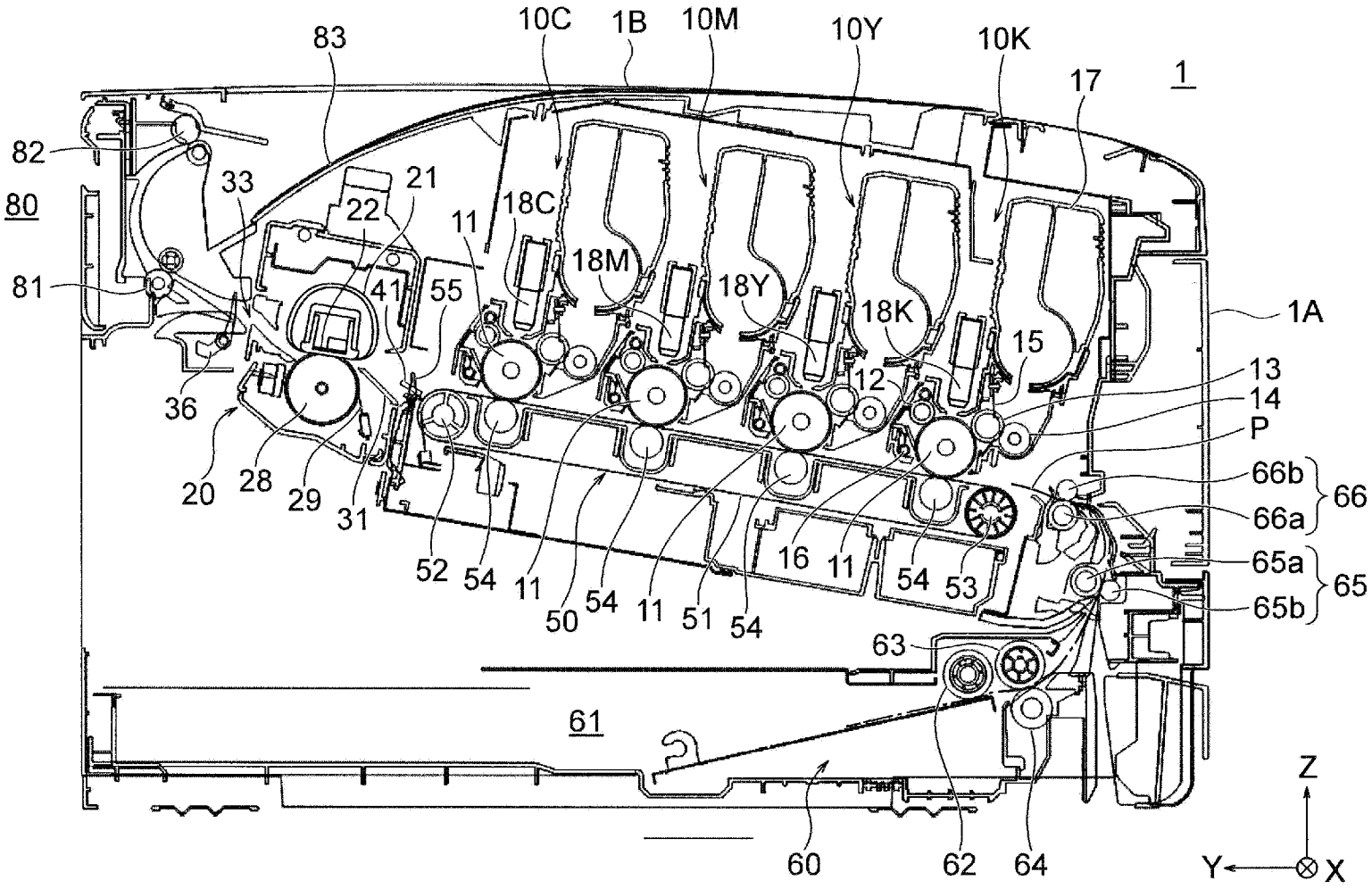
FIG. 1 is a diagram illustrating a basic configuration of an image formation apparatus according to an embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Image Formation Apparatus

First, an image formation apparatus according to an embodiment is described. FIG. 1 is a diagram illustrating a view of an image formation apparatus 1 according to an embodiment. The image formation apparatus 1 is configured to form an image by an electrophotographic method, and is, for example, a color printer.

The image formation apparatus 1 includes a medium supply unit 60 that supplies a medium P, process units 10K, 10Y, 10M, and 10C serving as image formation units that form toner images (developer images) of black (K), yellow (Y), magenta (M), and cyan (C), a transfer unit 50 that transfers the toner images to the medium P, a fixation unit 20 that fixes the toner images on the medium P, and a medium discharge unit 80 that discharges the medium P.

These components are housed in a housing 1A. A top cover 1B which can be opened and closed is provided at an upper part of the housing 1A. In addition to the printing paper, OHP (Overhead Projector) sheets, envelopes, copying paper, special paper, etc. can be used as the medium P.

The medium supply unit 60 includes a medium tray 61 accommodating therein the media P in a stacked manner, a pickup roller 62 in contact with the uppermost one of the accommodated media P in the medium tray 61, a feed roller 63 provided in the vicinity of the pickup roller 62, and a retard roller 64 provided being opposed to the feed roller 63.

The pickup roller 62 rotates with being in contact with the medium P on the medium tray 61, and thereby takes out the medium P from the medium tray 61. The feed roller 63 feeds the medium P that is taken out by the pickup roller 62 to a medium conveyance path. The retard roller 64 is rotated in a direction opposite to the feed direction by the feed roller 63 to apply a resistance to the medium P, so as to prevent an overlapped feeding of the media P.

The medium supply unit 60 also includes, along the medium conveyance path, a pair of conveyance rollers 65 and a pair of conveyance rollers 66. The conveyance rollers 65 include a resist roller 65*a* and a pinch roller 65*b*. The conveyance rollers 65 correct the skew of the medium P when the leading end of the medium P comes in contact with a nip of the rollers 65*a* and 65*b*, and then start rotating at a predetermined time after the leading end of the medium P comes in contact with the rollers 65*a* and 65*b*, so as to convey the medium P. The conveyance rollers 66 include a pair of rollers 66 and convey the medium P from the conveyance rollers 65 to the transfer unit 50.

The process units 10K, 10Y, 10M, and 100 are arranged from upstream to downstream (from right to left in FIG. 1) along the medium conveyance path.

Above the process units 10K, 10Y, 10M, and 10C, exposure heads 18K, 18Y, 18M, and 18C as print heads are disposed so as to face photosensitive drums 11, respectively. The exposure heads 18K, 18Y, 18M, and 18C are suspended and supported by the top cover 1B.

Since the process units 10K, 10Y, 10M, and 100 have a common configuration, the units may be simply referred as "process unit 10" below. The process unit 10 comprises the cylindrical photosensitive drum 11 as an image carrier, a charging roller 12 as a charging member that uniformly charges the surface of the photosensitive drum 11, and a development roller 13 as a developer carrier that attaches toner (developer) to an electrostatic latent image on the surface of the photosensitive drum 11 to form a toner image.

The process unit 10 also includes a supply roller 14 as a supplying member that supplies toner to the development roller 13, a development blade 15 as a regulating member that regulates the thickness of the toner layer formed on the surface of the development roller 13, a cleaning roller 16 that removes transfer residual toner remaining on the surface of the photosensitive drum 11, and a toner cartridge 17 as a developer housing that supplies toner to the supply roller 14.

The transfer unit 50 includes a transfer belt 51 which runs as adsorbing the medium P, and a drive roller 52 and a tension roller 53 on which the transfer belt 51 is stretched across. The drive roller (downstream roller) 52 is disposed at the downstream side of the conveyance direction of the medium P, and the tension roller 53 is disposed at the upstream side of the conveyance direction of the medium P. The drive roller 52 rotates counterclockwise in FIG. 1 by the driving force of the belt drive roller.

The transfer unit 50 also includes a transfer roller 54 as a transfer member disposed opposite to the photosensitive drum 11 of each process unit 10 via a transfer belt 51. A transfer voltage is applied to the transfer roller 54 to transfer the toner image of each color formed on the photosensitive drum 11 to the medium P on the transfer belt 51.

The fixation unit 20 includes a fixation belt 21, a heater 22, and a pressure roller 28. A nip is formed between an outer circumferential surface of the fixation belt 21 and the pressure roller 28. When the medium P passes through the nip, the fixation unit 20 applies heat and pressure to the toner image on the medium P to fix the toner image on the medium P. The configuration of the fixation unit 20 is described later.

The medium discharge unit 80 includes a pair of discharging rollers 81 and a pair of discharging rollers 82 that convey the medium P that has passed through the fixation unit 20 and discharge the medium P from a discharge port. The top cover of the image formation apparatus 1 is formed with a stacker 83 on which the media P discharged by the discharging rollers 81 and 82 are stacked and accumulated.

In FIG. 1, the image formation apparatus 1 is assumed to be placed on the XY plane. The axial direction of the photosensitive drum 11 and the rollers of the image formation apparatus 1 is oriented in the X direction in this example. The X direction is also the width direction of the medium P. A direction orthogonal to the X direction in the XY plane is referred to as the Y direction (a front-rear direction in this example). A direction perpendicular to the XY plane is referred to as the Z direction. In the example illustrated in FIG. 1, the XY plane is a horizontal plane and the Z direction is a vertical direction.

Regarding the Y direction, the forward (traveling) direction in the movement direction of the medium P when passing through the process units 10K, 10Y, 10M, and 10C is referred to as the +Y direction, and the backward direction is referred to as the −Y direction. The movement direction of the medium P when passing through the process units 10K, 10Y, 10M, and 100 is inclined at a predetermined angle with respect to the Y direction.

However, these directions are intended to facilitate understanding of the configuration of the image formation apparatus 1, and do not limit the orientation of the image formation apparatus 1 in use.

Configuration of Fixation Unit

Figure 2:
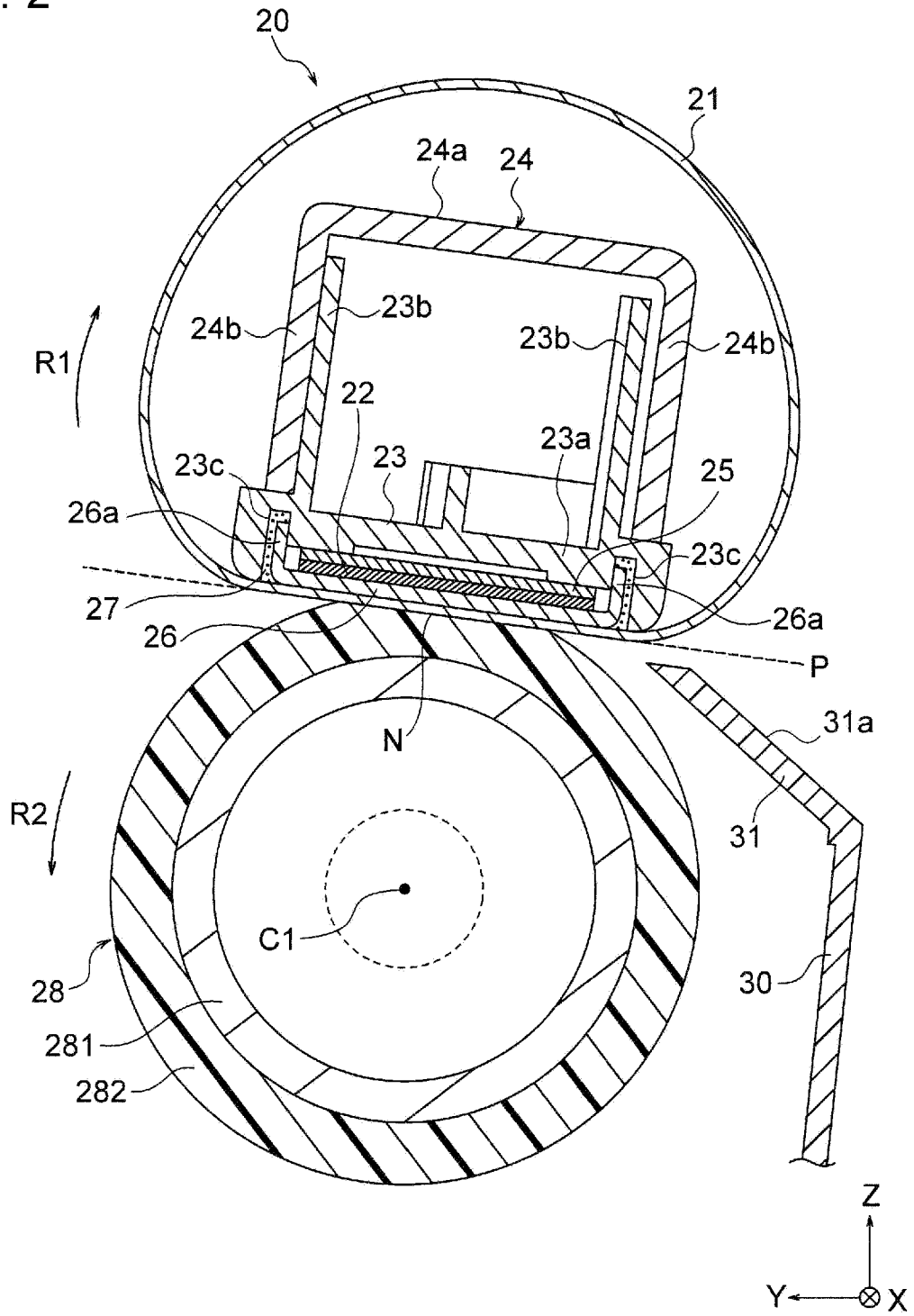
FIG. 2 is a diagram illustrating a cross sectional view of a fixation unit according to an embodiment.

FIG. 2 is a diagram illustrating a cross sectional view of the fixation unit 20. As illustrated in FIG. 2, the fixation unit 20 includes the fixation belt 21 serving as a fixation member, the heater 22 serving as a heat generating member, a heater holder 23, a stay 24 serving as a support, a heat conduction plate 25, a separation plate 26, and the pressure roller 28 serving as a pressurizing member.

The fixation belt 21 is an endless belt, and its width direction is in the X direction. The fixation belt 21 includes, for example, a base layer formed of stainless steel, an elastic layer formed of silicone rubber on the surface of the base layer, and a surface layer formed of PFA (tetrafluoroethylene perfluoroalkyl vinyl ether copolymer) covering the elastic layer. The fixation belt 21 belt rotates following the pressure roller 28 in the direction indicated by the arrow R1.

The heater 22, the stay 24, the heater holder 23, the heat conduction plate 25, and the separation plate 26 are disposed in the inner circumference side of the fixation belt 21. The fixation belt 21 is heated from the inner circumference side by the heater 22.

The heater 22 is a surface heater and is long in the X direction. The heater 22 is disposed with a heated surface side facing the inner circumference of the fixation belt 21.

The stay 24 is a structure supporting the heater 22, the heater holder 23, the heat conduction plate 25 and the separation plate 26. The stay 24 is formed, for example, of metal. The stay 24 has a substantially U-shaped cross section in a plane perpendicular to the X direction. More specifically, the stay 24 includes two side plate portions 24*b* opposed to each other in the Y direction and a top plate portion 24*a* connecting ends of the side plate portions 24*b* in the +Z direction.

The heater holder 23 is fixed to a portion of the stay 24 on the pressure roller 28 side and supports the heater 22 with respect to the stay 24. The heater holder 23 is formed of a resin such as PEEK (polyetheretherketone), for example.

The heater holder 23 includes two side plate portions 23*b* disposed between the two side plate portions 24*b* of the stay 24, and a bottom plate portion 23*a* connecting ends of the side plate portions 23*b* in the −Z direction. The heater 22 is attached to the bottom plate portion 23*a* of the heater holder 23 via the heat conduction plate 25.

The heat conduction plate 25 is a plate-like member disposed between the bottom plate portion 23*a* of the heater holder 23 and the heater 22. The heat conduction plate 25 is formed, for example, of stainless steel (SUS).

The separation plate 26 is a plate-like member disposed between the heater 22 and the fixation belt 21. The separation plate 26 is made of, for example, glass-coated stainless steel. The separation plate 26 diffuses the heat of the heater 22 and transfers the heat to the fixation belt 21, and has effects of equalizing the temperature distribution of the fixation belt 21 in a later described fixation nip N.

The separation plate 26 is formed with a pair of bent portions 26*a* at both ends thereof in the Y direction. The bent portions 26*a* are respectively inserted into and fixed to grooves 23*c* of the bottom plate 23*a* of the heater holder 23. The heater 22 and the heat conduction plate 25 are held in a state sandwiched between the bottom plate portion 23*a* of the heater holder 23 and the separation plate 26.

It may be preferable to interpose a liquid lubricant 27 (e.g., lubricating oil) between the heater 22 and the inner circumferential surface of the fixation belt 21 to reduce the frictional resistance therebetween. The liquid lubricant 27 is, for example, applied to the inner circumferential surface of the fixation belt 21.

The pressure roller 28 is a roller having an axial direction in the X direction, and is supported to be rotatable about the rotation axis C1 thereof extending in the X direction. The pressure roller 28 is pressed against the heater 22 through the fixation belt 21 to form the fixation nip N between the pressure roller 28 and the fixation belt 21.

The pressure roller 28 includes a shaft 281 made of a metal, such as free-cutting steel (SUM), and an elastic layer 282 made of silicone rubber covering the surface of the shaft 281. The driving force of the fixation motor is transmitted to one end (axle portion) of the shaft 281 in the X direction. This causes the pressure roller 28 to rotate in the direction indicated by the arrow R2.

The temperature of the surface of the pressure roller 28 is detected by a temperature sensor 29 (FIG. 1). The temperature sensor 29 is, for example, a thermistor, but may also be, for example, a non-contact sensor. A detection signal of the temperature sensor 29 is sent to a temperature control circuit and the heating of the heater 22 is controlled.

Figure 3:
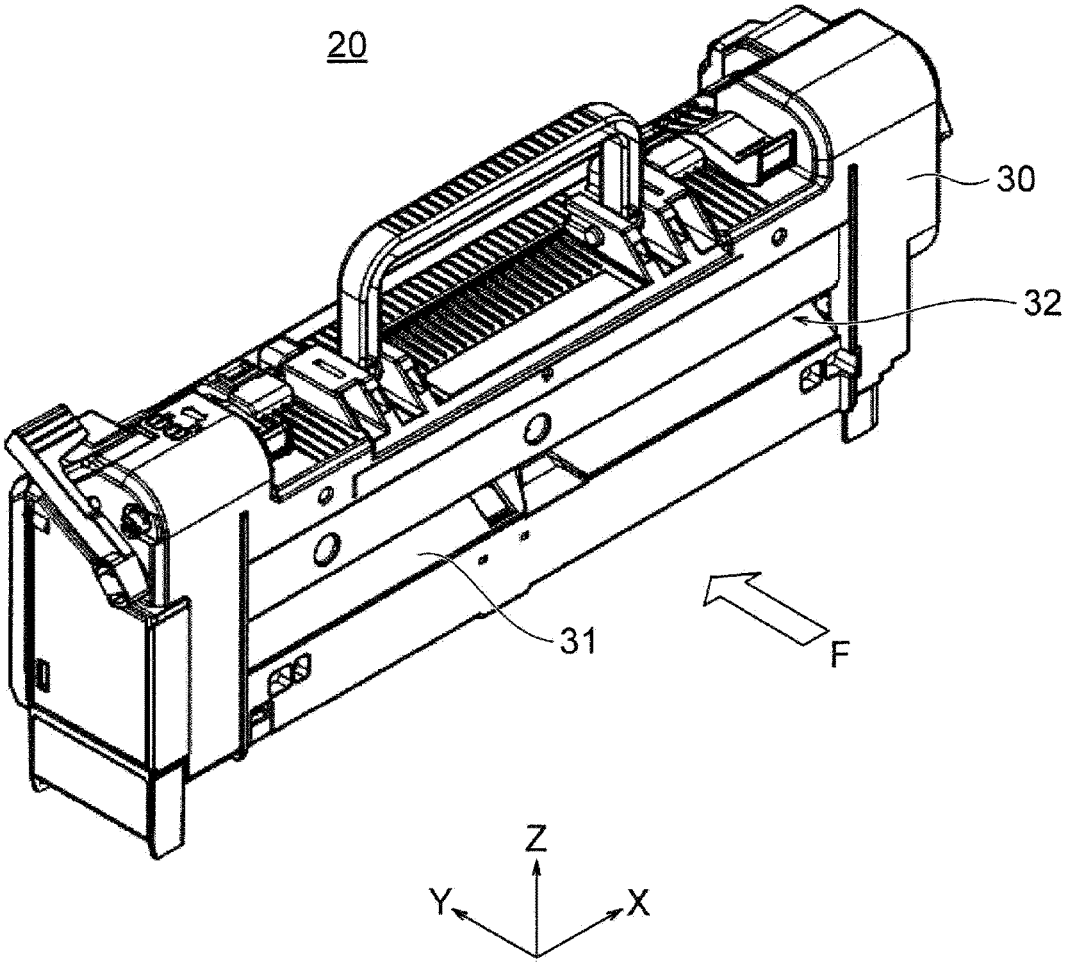
FIG. 3 is a diagram illustrating a perspective view of the fixation unit according to an embodiment.

Next, the structure supporting the components of the fixation unit 20 is described. FIG. 3 is a diagram illustrating a perspective view of an outline of the fixation unit 20. The fixation unit 20 is covered by a housing 30 of the fixation unit 20. An inlet 32 (introduction port) is formed on the −Y side of the housing 30, and an outlet (a discharge port) is formed on the +Y side of the housing 30. The medium P is introduced into the inlet 32 in the direction indicated by the arrow F.

Figure 4:
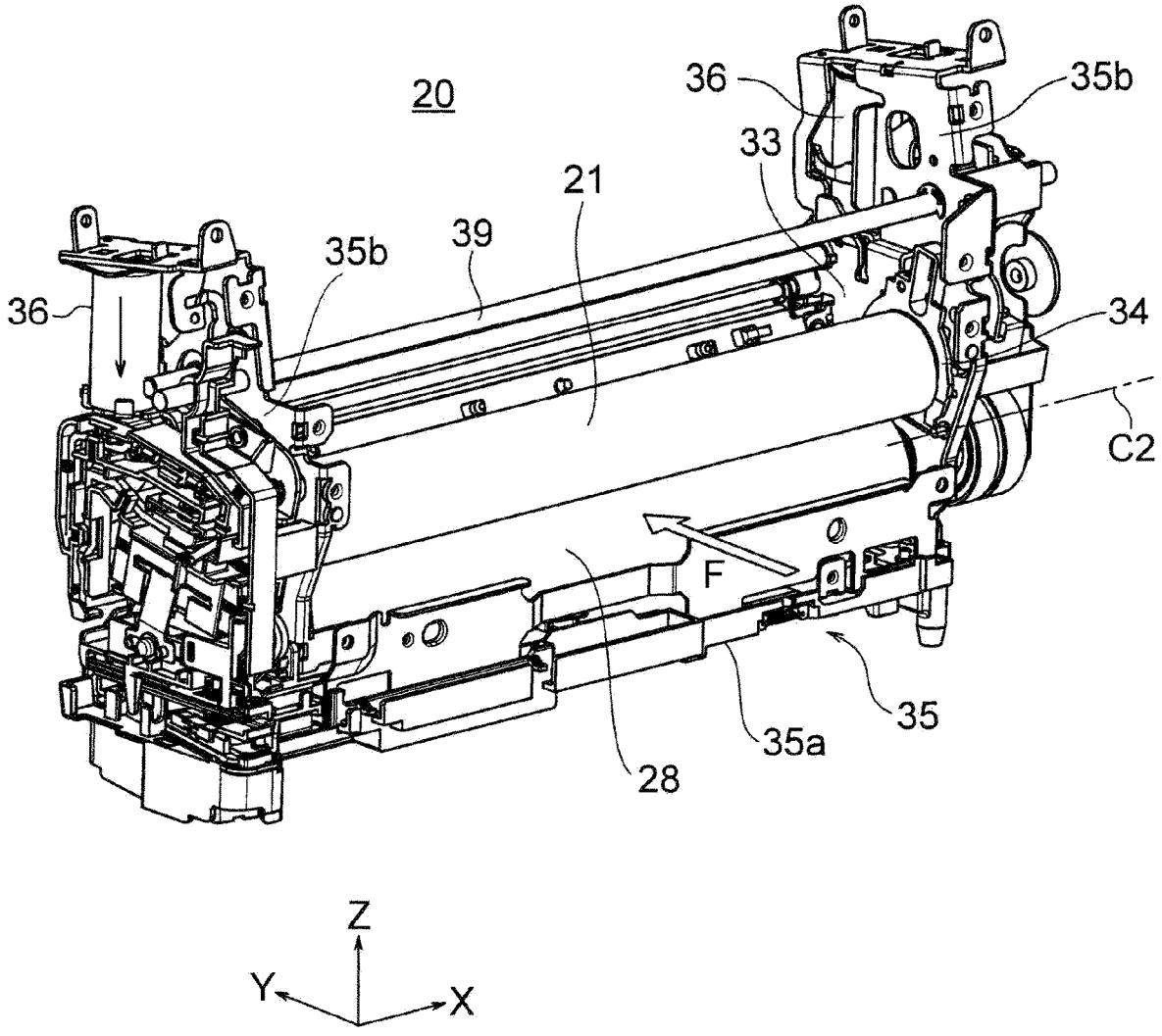
FIG. 4 is a diagram illustrating a perspective view of an internal configuration of the fixation unit according to an embodiment.

FIG. 4 is a diagram illustrating a perspective view of the internal configuration of the fixation unit 20. As illustrated in FIG. 4, the fixation unit 20 includes a fixed frame 35 that supports each element of the fixation unit 20. The fixed frame 35 includes a pair of side plates 35*b* located at both ends in the X direction of the fixation unit 20 and a base portion 35*a* supporting the side plates 35*b*. The pressure rollers 28 are rotatably supported by bearing portions attached to the pair of side plates 35*b*.

A pair of rotatable frames 33 (one of which is illustrated in FIG. 4) are provided on inner sides of the pair of side plates 35*b* in the X direction. The rotatable frames 33 (pivoting frames) are mounted on the side plates 35*b* to be rotatable about the rotation axis C2 thereof extending in the X-direction with respect to the side plates 35*b*.

A substantially cylindrical flange member 34 is attached to each of the rotatable frames 33. A part of the flange member 34 is inserted into the inner circumference of the fixation belt 21 at the end portions of the fixation belt 21 in the X-direction, and thus supports the fixation belt 21 from the inner circumference side of the fixation belt 21.

The end portions of the stay 24 (FIG. 2) in the X-direction are fixed to the rotatable frames 33, respectively. The stay 24 and members supported by the stay 24 (the fixation belt 21, the heater 22, the heater holder 23, the heat conduction plate 25, and the separation plate 26) are supported by the pair of the rotatable frames 33.

A bias member 36 is attached to each of the side plates 35*b*. The bias member 36 is, for example, a coil spring. The bias members 36 bias the rotatable frames 33 so as to rotate the rotatable frames 33 in a direction in which the fixation belt 21 is separated from the pressure roller 28.

Cams (not illustrated) are rotatably attached to the side plates 35*b* respectively and are connected to each other by a connecting shaft 39 extending in the X direction. The cams rotate by means of rotation transmission from a cam motor.

The rotation of the cams causes the rotatable frame 33 to rotate in a first direction (in the direction in which the fixation belt 21 is separated from the pressure roller 28) or in a second direction (in a direction in which the fixation belt 21 contacts the pressure roller 28).

During a fixing operation, the fixation belt 21 contacts the pressure roller 28 to form the fixation nip N (FIG. 2). To the contrary, after the completion of the fixing operation, the fixation belt 21 is separated from the pressure roller 28 to open the fixation nip N.

Operation of Image Formation Apparatus

The operation of the image formation apparatus 1 is as follows. When a controller or a controller of the image formation apparatus 1 receives a print command and print data from a host device or an external device, the controller starts an image forming operation. First, the pickup roller 62 rotates to feed the medium P from the medium tray 61 to the conveyance path, and the conveyance rollers 65, 66 convey the medium P to the transfer unit 50 along the conveyance path.

In the transfer unit 50, the transfer belt 51 runs by rotation of the drive roller 52, and the transfer belt 51 adsorbs and holds the medium P and conveys the medium P along the conveyance path. The medium P being conveyed by the transfer belt 51 passes through the process units 10K, 100, 10M, and 10Y in this order.

A controller 100 performs formation of toner images of respective colors in the process units 10K, 10Y, 10M, and 100. That is, a charging voltage, a developing voltage and a supply voltage are applied to the charging roller 12, the development roller 13 and the supply roller 14 of each process unit 10, respectively.

The photosensitive drum 11 of each process unit 10 rotates, and the charging roller 12, the development roller 13, and the supply roller 14 also rotate along with the rotation of the photosensitive drum 11. The charging roller 12 uniformly charges the surface of the photosensitive drum 11. The exposure head 18 exposes the surface of the photosensitive drum 11 with lights to thereby form an electrostatic latent image on the surface of the photosensitive drum 11.

In each process unit, the electrostatic latent image formed on the surface of the photosensitive drum 11 is developed by the toner attached to the development roller 13, and thus a toner image is formed on the surface of the photosensitive drum 11. The toner image formed on the surface of the photosensitive drum 11 is transferred to the medium P on the transfer belt 51 by a transfer voltage applied to the transfer roller 54.

In this way, the toner images of the respective colors formed by the process units 10K, 10C, 10M, and 10Y are sequentially transferred and thus superposed onto the medium P. The medium P onto which the toner images of the respective colors have been transferred is further conveyed by the transfer belt 51 and reaches the fixation unit 20.

In the fixation unit 20, the pressure roller 28 rotates and the fixation belt 21 rotates following the pressure roller 28. The heater 22 is heated to a predetermined fixation temperature. The medium P conveyed from the transfer unit 50 to the fixation unit 20 is heated and pressurized when passing through the fixation nip N between the fixation belt 21 and the pressure roller 28, and the toner images are fixed to the medium P.

The medium P on which the toner images have been fixed is discharged by the discharging rollers 81 and 82 to the outside of the image formation apparatus 1 and loaded on the stacker 83. This completes the formation of the color image on the medium P.

Medium Conveyance Guide Between Transfer Unit and Fixation Unit

Figure 5:
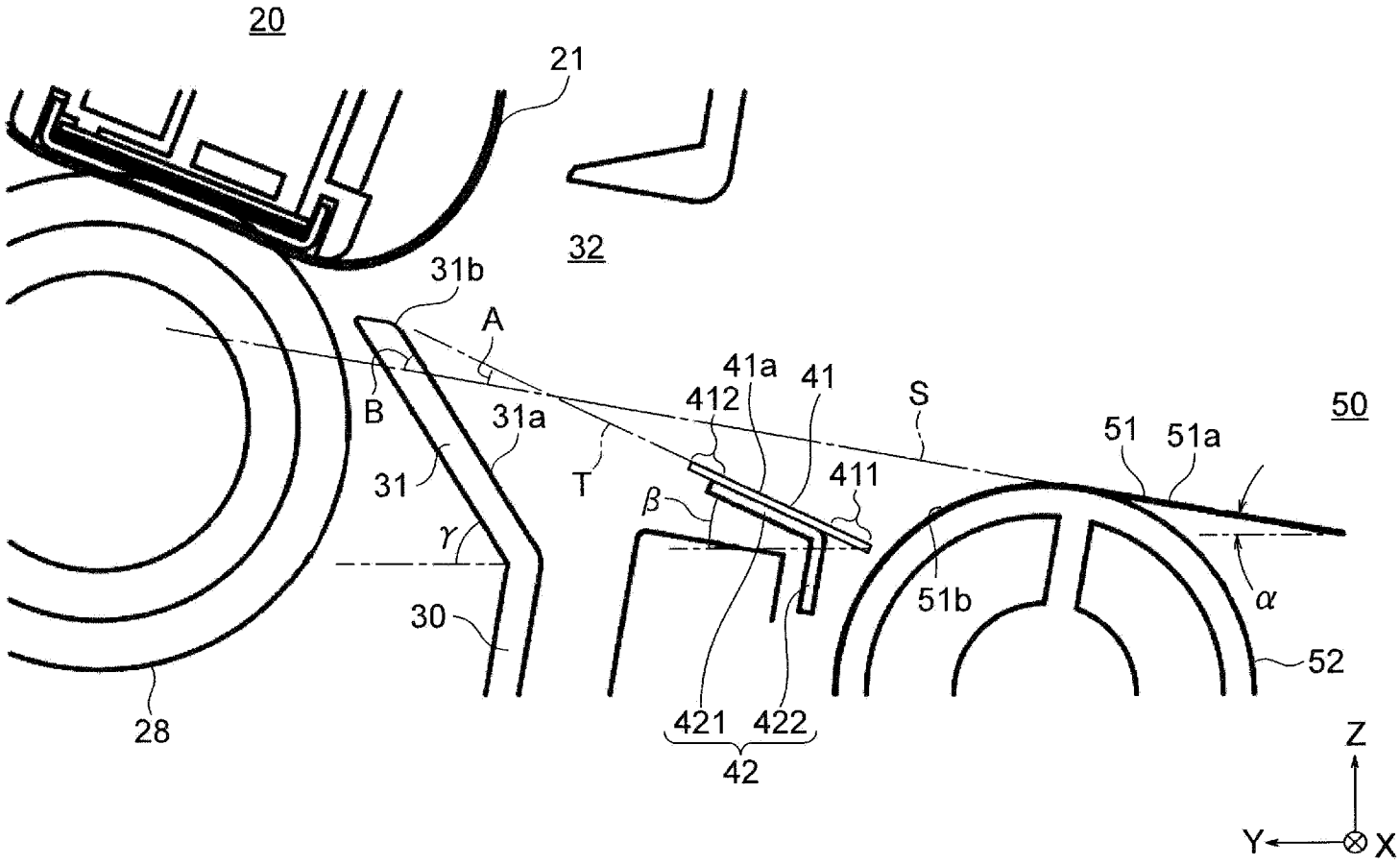
FIG. 5 is a diagram illustrating a configuration for conveying and guiding a medium from a transfer unit to the fixation unit according to an embodiment.

FIG. 5 is a diagram illustrating a configuration for conveying and guiding the medium P between the transfer unit 50 and the fixation unit 20. The medium P is adsorbed on the surface of the transfer belt 51 and conveyed. A flat portion of the surface of the transfer belt 51 on the process unit 10 side is defined as a conveyance surface 51*a*. That is, a plane of a part of the surface (outer circumferential surface) of the transfer belt 51 that is located between the drive roller 52 and the tension roller 53 and that faces the photosensitive drum 11 is defined as the conveyance surface 51*a*.

A virtual plane extending the conveyance surface 51*a* of the transfer belt 51 is referred to as a conveyance reference plane S. The conveyance reference plane S is parallel to the X direction, but is inclined by an angle α to the XY plane (horizontal plane). The fixation nip N of the fixation unit 20 is located on the upper side (+Z side) than the conveyance reference plane S.

The medium P is separated from the transfer belt 51 at a portion where the transfer belt 51 is curved along the surface of the drive roller 52 and is transported toward the fixation unit 20.

In order to separate the medium P from the transfer belt 51 and guide the medium P toward the fixation unit 20, a separation film 41 serving as a separating member is disposed on the +Y side of the drive roller 52. Since the separation film 41 is disposed close to the fixation unit 20, it is made of a resin having high heat resistance, such as polycarbonate.

The separation film 41 is disposed facing the surface (indicated by the reference numeral 51*b*) curved along the outer circumference of the drive roller 52 of the transfer belt 51, to easily separate the medium P from the transfer belt 51.

The separation film 41 is supported by a support 42. The support 42 is made of, for example, sheet metal. The support 42 includes a flat plate-shaped support portion 421 to which the separation film 41 is fixed, and an opposing portion 422 extending downwardly from an end of the −Y side of the support portion 421.

The support portion 421 includes a support surface facing the conveyance reference plane S, and the separation film 41 is fixed to the support surface. The opposing portion 422 extends from the support portion 421 along the surface of the drive roller 52. When the medium P comes in contact with a first protruding portion 411 (described below) of the separation film 41 and thus the first protruding portion 411 is bent downward, the opposing portion 422 of the support 42 can support the separation film 41 that is bent.

The surface of the separation film 41 is a flat surface and serves as a guide surface 41*a* for guiding the medium P. The guide surface 41*a* is located below the conveyance reference plane S (in the −Z direction). The guide surface 41*a* is parallel to the X direction, but is inclined at an angle β to the XY plane. The guide surface 41*a* is arranged at an angle such that the distance from the guide surface 41*a* to the conveyance reference plane S becomes shorter (i.e., in the +Y direction) as it is closer to the fixation unit 20.

The inclination angle β of the guide surface 41*a* with respect to the XY plane is greater than the angle α of the conveyance reference plane S with respect to the XY plane (β>α). With reference to the conveyance reference plane S, the guide surface 41*a* is inclined by an angle A (=β−α) with respect to the conveyance reference plane S.

The separation film 41 includes the first protruding portion 411 projecting from the support portion 421 to the drive roller 52 side (−Y side) and a second protruding portion 412 projecting from the support portion 421 to the fixation unit 20 side (+Y side).

The first protruding portion 411 of the separation film 41 extends to the vicinity of the surface 51*b* of the transfer belt 51 that is curved along the surface of the drive roller 52 so that the medium P can be easily separated from the transfer belt 51. However, in order to prevent the transfer belt 51 from being scratched by the separation film 41, the tip of the first protruding portion 411 of the separation film 41 is slightly separated from the surface of the transfer belt 51.

Figure 8:
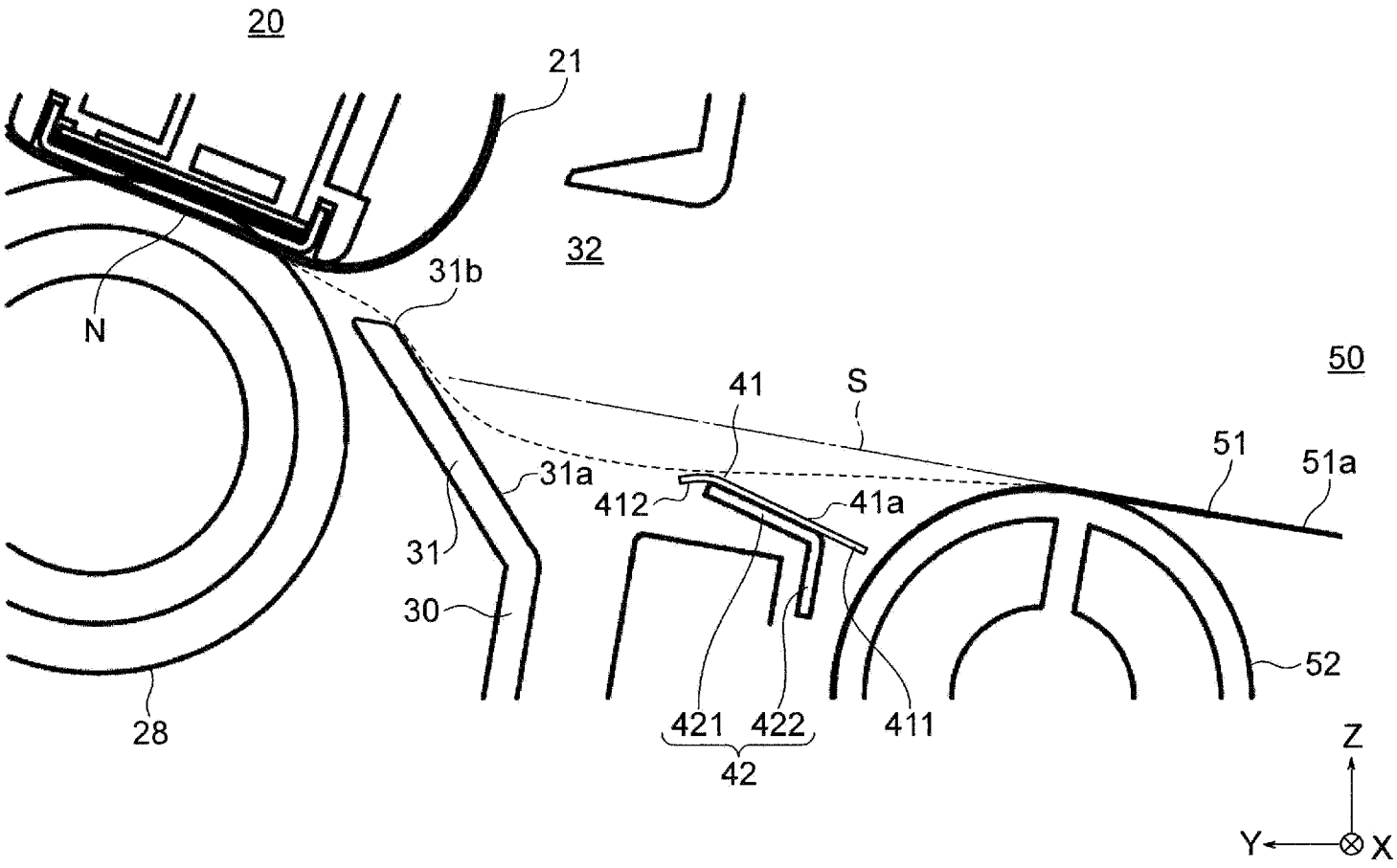
FIG. 8 is a diagram illustrating a schematic view of another example of a medium conveyance state according to an embodiment.

In a case where thick paper is used as the medium P, the second protruding portion 412 of the separation film 41 is deformed when the medium P comes in contact with the second protruding portion 412, so as to secure a deflection area for the medium P (see FIG. 8).

Figure 6:
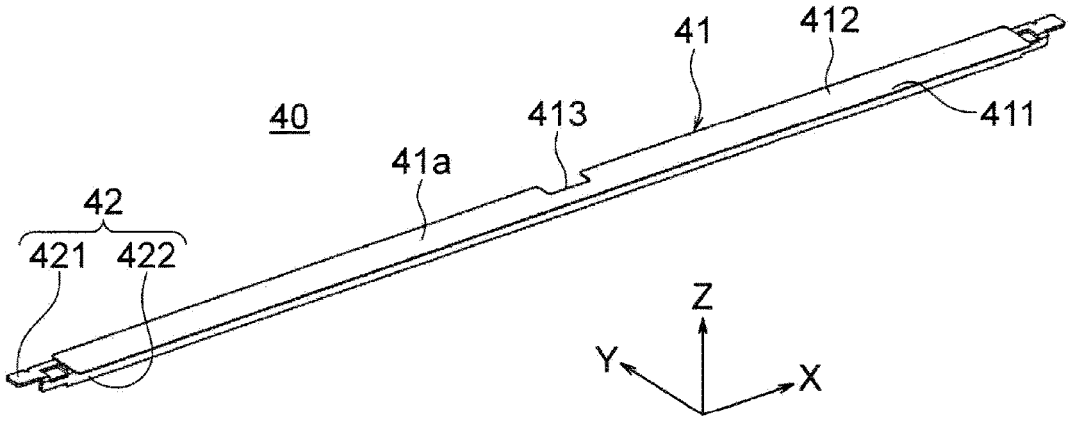
FIG. 6 is a diagram illustrating a perspective view of a separation film and a support according to an embodiment.

FIG. 6 is a diagram illustrating a perspective view of the separation film 41 and the support 42. The separation film 41 and the support 42 are both long in the X direction. The separation film 41 and the support 42 together are also referred to as a separation unit 40.

The length of the separation film 41 in the X direction is, for example, 310 mm. The width of the separation film 41 in the Y direction is, for example, 11.5 mm. The length of the separation film 41 in the X direction is the same as the width of the transfer belt 51.

The support 42 protrudes from both ends of the separation film 41 in the X-direction and is attached to predetermined locations in the housing 1A (FIG. 1) of the image formation apparatus 1.

A notch 413 is formed on the +Y side of the center in the X direction of the separation film 41. The notch 413 is intended to prevent interference with a sensor lever 55 (FIG. 1) which detects the medium P.

The sensor lever 55 (FIG. 1) is disposed between the transfer unit 50 and the fixation unit 20, and is configured to fall down when the leading end of the medium P. comes in contact with the sensor lever 55. When the sensor lever 55 falls down, an optical sensor (not illustrated) detects the fall and emits a detection signal. This detection signal is used to determine whether or not there is a medium P between the transfer unit 50 and the fixation unit 20, when a jam of the medium P occurs.

The separation film 41 is preferable to be provided to face the entire width (X-direction dimension) of the transfer belt 51. However, the separation film 41 may be provided to face, for example, only both ends in the width direction (both ends in the X direction) of the transfer belt 51.

Returning to FIG. 5, on the inlet side, i.e., the −Y side of the fixation unit 20, a leading member 31 (or an introduction member) is formed to guide (lead) the medium P into the fixation nip N. The leading member 31 is formed on the lower side of the inlet 32 in the housing 30 (FIG. 3) of the fixation unit 20.

The leading member 31 includes a leading surface 31*a* that guides (leads) the medium P that has passed through the separation film 41 into the fixation nip N. The leading surface 31*a* is parallel to the X direction, but is inclined by an angle $\gamma$ to the XY plane. The leading surface 31*a* is provided at an angle such that the distance in the Z direction between the leading surface 31*a* and the fixation nip N becomes shorter (i.e., in the +Y direction) as it approaches the fixation unit 20.

The inclination angle $\gamma$ of the leading surface 31*a* is greater than the angles $\alpha$ and $\beta(\gamma>\beta, \gamma>\alpha)$. With reference to the conveyance reference plane S, the leading surface 31*a* of the leading member 31 is inclined by an angle B $(=\gamma-\alpha)$ with respect to the conveyance reference plane S.

The angle B of the leading surface 31*a* with respect to the conveyance reference plane S is greater than the angle A of the guide surface 41*a* with respect to the transfer reference surface S (B>A). Therefore, the medium conveyed along the guide surface 41*a* is smoothly guided along the leading surface 31*a*.

A part of the leading surface 31*a* is located on a virtual plane T extending the guide surface 41*a* of the separation film 41. In other words, a medium P (e.g., thin paper) conveyed along the guide surface 41*a* can be reliably brought into contact with the leading surface 31*a* and guided along the leading surface 31*a*.

A part of the leading surface 31*a* is located on the conveyance reference plane S. That is, a medium P (e.g., cardboard) conveyed along the conveyance reference plane S without contacting the guide surface 41*a* can be reliably brought into contact with the leading surface 31*a* and guided along the leading surface 31*a*.

Between an upper end of the leading member 31 and the leading surface 31*a*, a curved surface 31*b* (chamfered surface) is formed. This curved surface 31*b* is provided for preventing the medium P from being caught thereon and for smoothly leading the medium P into the fixation nip N.

Effects

Figure 7:
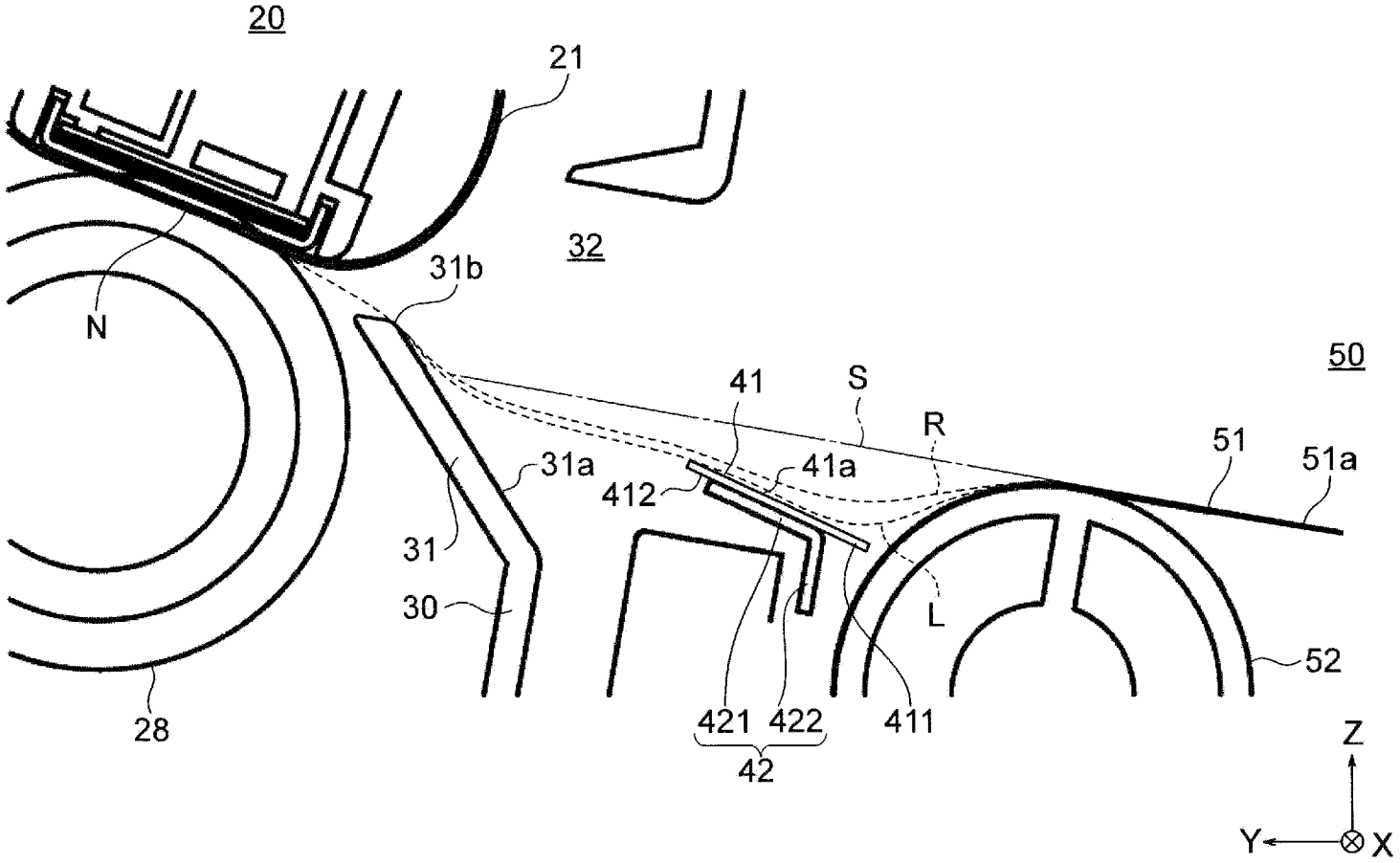
FIG. 7 is a diagram illustrating a schematic view of a medium conveyance state according to an embodiment.

FIG. 7 illustrates the conveyance state of the medium P from the transfer unit 50 to the fixation unit 20. Here, an example is described in which a relatively easily deformable (small basis weight) medium, i.e., thin paper, is used as the medium P. In FIG. 7, the path of one end (left end) of the medium P in the X direction is illustrated by the dashed line L, and the path of the other end (right end) of the medium P in the X direction is illustrated by the dashed line R.

The medium P conveyed by the transfer belt 51 is separated from the transfer belt 51 when the medium P passes a position where the transfer belt 51 starts curving along the outer circumferential surface of the drive roller 52. The medium P separated from the transfer belt 51 moves in a direction away from the conveyance reference plane S once, but contacts the guide surface 41*a* of the separation film 41 and moves along the guide surface 41*a*.

The guide surface 41*a* is inclined by the angle A (FIG. 5) with respect to the conveyance reference plane S. The guide surface 14*a* is arranged at the angle such that the distance from the guide surface 14*a* to the conveyance reference plane S becomes shorter as it extends in the +Y direction. Therefore, as the medium P advances along the guide surface 41*a*, the medium P approaches the conveyance reference plane S.

The medium P further contacts the leading surface 31*a* of the leading member 31 and advances along the leading surface 31*a*. Since the leading surface 31*a* is inclined to the conveyance reference plane S by the angle B (FIG. 5) greater than the angle A, the medium P advancing from the guide surface 41*a* contacts the leading surface 31*a* and is led along the leading surface 31*a* to the fixation nip N.

Thus, between the transfer unit 50 and the fixation unit 20, the medium P is guided by the guide surface 41*a* of the separation film 41 and the leading surface 31*a* of the leading member 31, and is conveyed while maintaining a slightly bent state.

Here, when the medium P is thin paper, the separation timing of the medium P from the transfer belt 51 may be different between both ends (both ends in the X direction) in the width direction of the medium P. In the example illustrated in FIG. 7, the right end R of the medium P is separated from the transfer belt 51 in the vicinity of the position where the transfer belt 51 starts to curve. To the contrary, the left end L of the medium P is separated from the transfer belt 51 slightly later than the right end of the medium P.

If the separation timing of the medium P from the transfer belt 51 differs between the right end R and the left end L of the medium P, the amount of deflection differs between the right end R and the left end L of the medium P, torsion (or twisting) of the medium P may occur. If the medium P is led into the fixation nip N in a torsional state (a twisted state), it may cause printing defects as described below (see FIGS. 10A and 10B).

However, in an embodiment described above, the distance between the guide surface 41*a* of the separation film 41 and the conveyance reference plane S becomes shorter as proceeding in the +Y direction, and thus the medium P approaches the conveyance reference plane S as it advances along the guide surface 41*a*. Therefore, even when the separation timing from the transfer belt 51 is different between the right end and the left end of the medium P, the difference in the amount of deflection between the right end R and the left end L of the medium P is reduced as the medium P advances along the guide surface 41*a*. Accordingly, the occurrence of torsion of the medium P is suppressed, and printing defects are suppressed.

Since a part of the leading surface 31*a* of the leading member 31 is located on a virtual plane T extending the guide surface 41*a* of the separation film 41, the medium P advancing along the guide surface 41*a* contacts the leading surface 31*a* and is smoothly led along the leading surface 31*a* to the fixation nip N.

FIG. 8 illustrates another example of a conveyance state of the medium P from the transfer unit 50 to the fixation unit 20. Here, an example is described in which a medium that is relatively difficult to deform (has a large basis weight), i.e., cardboard, is used as the medium P.

In this case, the medium P is separated from the transfer belt 51 in the vicinity of the position where the transfer belt 51 starts to curve, and proceeds along the conveyance reference plane S without much contact with the separation film 41. The medium P then contacts the second protruding portion 412 of the separation film 41 and proceeds toward the leading member 31 while deforming the second protruding portion 412. The medium P reaching the leading surface 31*a* of the leading member 31 is led by the leading surface 31*a* and reaches the fixation nip N.

When the medium P is such a thick paper, unlike the case of thin paper, the separation timing difference between both widthwise ends is unlikely to occur.

When the medium P is particularly thick, the medium P may reach the leading member 31 without coming into contact with the separation film 41 at all after being separated from the transfer belt 51. Even in such a case, since a part of the leading surface 31*a* of the leading member 31 is located on (intersects with) the conveyance reference plane S, the medium P is smoothly led along the leading surface 31*a* to the fixation nip N.

Comparative Example

Figure 9:
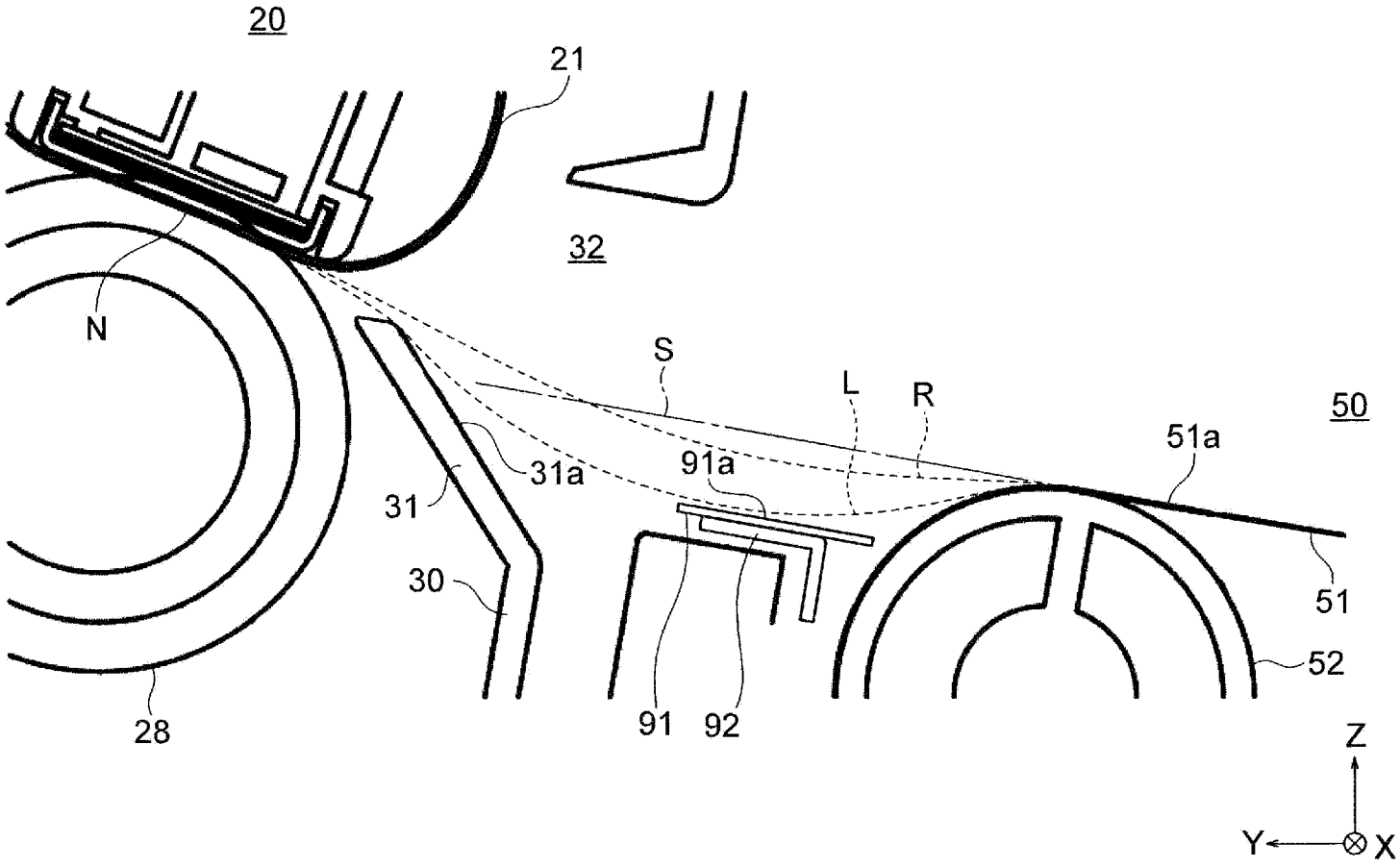
FIG. 9 is a diagram illustrating a schematic view of a medium conveyance state according to a comparative example.

FIG. 9 is a diagram illustrating a transport state of the medium P from the transfer unit 50 to the fixation unit 20 according to a comparative example. In the comparative example, the configuration of a separation film 91 is different from that of the separation film 41 according to an embodiment described above.

In other words, the separation film 91 according to the comparative example is provided to separate the medium P from the transfer belt 51, but a guide surface 91*a* of the separation film 91 is parallel to the conveyance reference plane S. The material of the separation film 91 is the same as that of the separation film 41 according an embodiment described above.

The separation film 91 is supported by a support 92 made of sheet metal or the like. The support 92 is different from the support 42 in that the support 92 supports the separation film 91 so that the guide surface 91*a* is parallel to the conveyance reference plane S.

Here, in the comparative example, a case in which the separation timing of the thin medium P such as thin paper from the transfer belt 51 is different between both widthwise ends of the medium P is described. In the example illustrated in FIG. 9, the right end R of the medium P is separated from the transfer belt 51 in the vicinity of the position where the transfer belt 51 starts to curve. To the contrary, the left end L of the medium P is separated from the transfer belt 51 slightly later than the right end R of the medium P.

The amount of movement of the left end L of the medium P, which is separated from the transfer belt 51 later than the right end R, is greater than the amount of movement of the right end R of the medium P. Therefore, as illustrated in FIG. 10A, the amount of deflection of the left end L of the medium P is greater than that of the right end R. In other words, the medium P is conveyed in a torsional state (a twisted state).

In the comparative example, since the separation film 91 is provided parallel to the conveyance reference plane S, the difference in the amount of deflection between both widthwise ends of the medium P cannot be reduced by the separation film 91.

When the medium P is led into the fixation nip N in a torsional state and is sandwiched between the fixation belt 21 and the pressure roller 28, friction occurs between the right end of the medium P having a small amount of deflection and the fixation belt 21. As a result, the toner image on the medium P has a dense area (unevenness) on the right end R as illustrated in FIG. 10B. Such unevenness is referred to as "blurring".

To the contrary, according to an embodiment described above, as illustrated in FIG. 7, the guide surface 41*a* of the separation film 41 is arranged at the angle such that the distance from the guide surface 41*a* to the conveyance reference plane S becomes shorter as proceeding in the +Y direction. Therefore, the further the medium P advances along the guide surface 41*a*, the closer the medium P approaches the conveyance reference plane S.

As a result, even if the separation timing from the transfer belt 51 differs between the right end R and the left end L of the medium P, the difference in the amount of deflection (difference in the amount of movement) between the right end R and the left end L of the medium P is reduced by being led along the separation film 41. Accordingly, the occurrence of torsion of the medium P is suppressed, and printing defects (blurring) as seen in the comparative example are suppressed.

Next, the results of experiments on the occurrence of blurring regarding an embodiment and the comparative example are described. In the experiments, a test image is continuously printed on 100 sheets of media P in a case where the image formation apparatus 1 according to an embodiment is used and in a case where the separation film 91 according to the comparative example is used instead of the separation film 41, and all 100 printed sheets are visually observed to check for blurring. Three image formation apparatuses according to an embodiment and three image formation apparatuses according to the comparative example are used, to perform continuous printing on 100 sheets of media P by each apparatus (total of 300 sheets), and all printing results are visually observed.

As the image formation apparatus 1, the image formation apparatus 1 (color printer) illustrated in FIG. 1 is used, and the test image is formed using the magenta process unit 10M. A solid image with a duty ratio of 20% is used as the test image.

The printing is performed under three environments (printing conditions): a temperature of 25° C. and relative humidity of 50% (NN environment), a temperature of 10° C. and relative humidity of 20% (LL environment), and a temperature of 30° C. and relative humidity of 80% (HH environment).

As the medium P, "Multi Paper Minus 6%" manufactured by ASKUL Corporation with a basis weight of 60 g/m$^2$ is used as a representative of the thin paper P1. As a representative of the thick paper P2, "Color Copy (CC) 90" manufactured by Mondi Tokyo KK having a basis weight of 90 g/m$^2$ is used.

The number of sheets of media P on which blurring is observed out of 300 sheets of media P on which the continuous printing is performed as described above is counted, and a blurring rate (%) is determined. For example, if blurring is observed on three of the 300 sheets of media P, the blurring rate is assumed to be 1%. The results are shown in FIG. 11.

Figure 12:
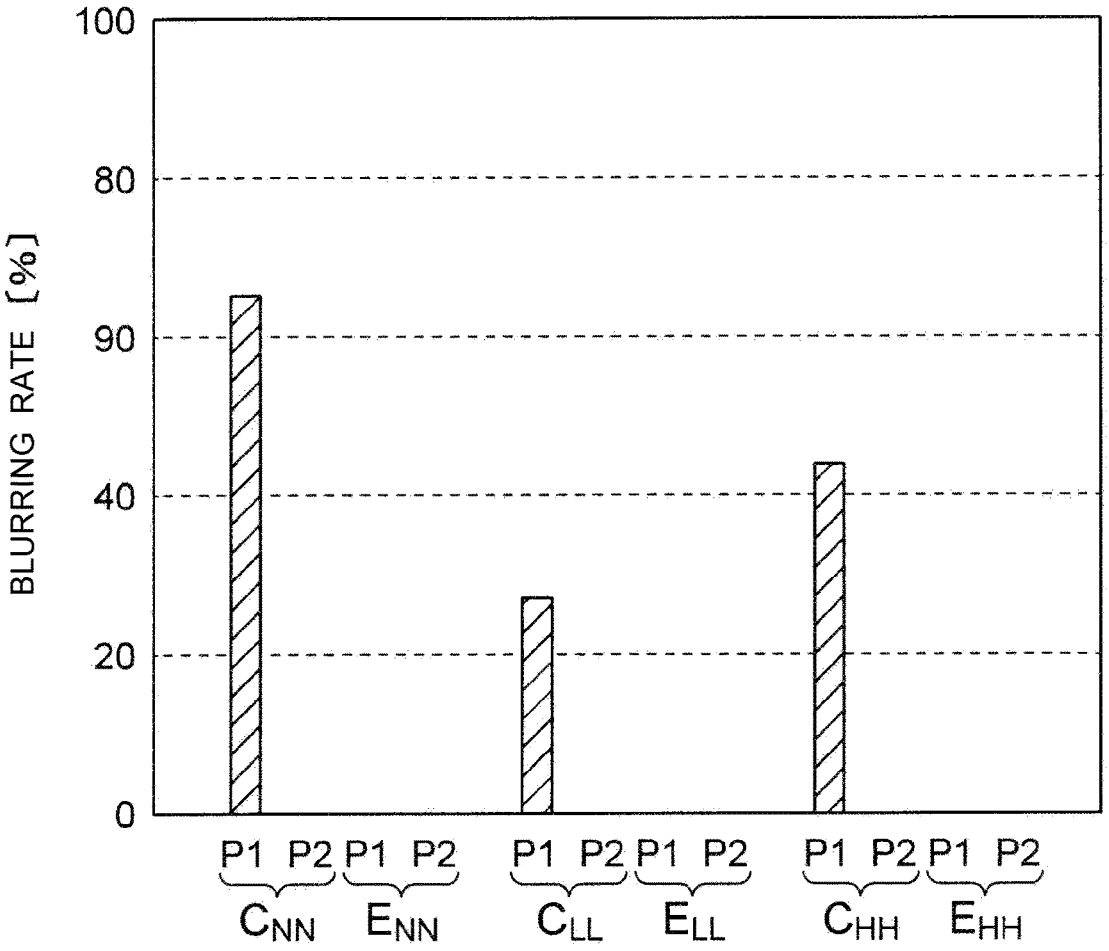
FIG. 12 is a graph illustrating a comparison of blurring rates between an embodiment and a comparative example.

FIG. 12 illustrates the results of the experiments illustrated in FIG. 11. In FIG. 12, the CNN indicates the experimental results in the NN environment with the image formation apparatus according to the comparative example, and the ENN indicates the experimental results in the NN environment with the image formation apparatus according to an embodiment. The CLL indicates the experimental results in the LL environment with the image formation apparatus according to the comparative example and the ELL indicates the experimental results in the LL environment with the image formation apparatus according to an embodiment. The CHH indicates the experimental results in the HH environment with the image formation apparatus according to the comparative example and the EHH indicate the experimental results in the HH environment with the image formation apparatus according to an embodiment.

As is apparent from FIGS. 11 and 12, when the thick paper P2 (basis weight 90 g/m$^2$) is used as the medium P, no blurring is observed in all the three environments in both cases according to an embodiment and the comparative example.

On the other hand, when the thin paper P1 (basis weight 60 g/m$^2$) is used as the medium P, in all the three environments, blurring is observed in the case according to the comparative example and no blurring is observed in the case according to an embodiment.

From the results, it is understood that, according to an embodiment, since the guide surface 41*a* of the separation film 41 is arranged at the angle such that the distance from the guide surface 41*a* to the conveyance reference plane S becomes shorter as proceeding in the +Y direction, the difference in the amount of deflection (difference in the amount of movement) between the right end R and the left end L of the medium P is reduced and the occurrence of blurring is suppressed.

In the above description, the separation film 41 is described as an example of a separating member that separates the medium P from the transfer belt 51. However, in the disclosure, as a separating member, not only the separation film but also another separating member (e.g., resin separation plates, etc.) may be used.

In the above description, the case has been described in which the leading member 31 having the leading surface 31*a* is a part of the fixation unit 20. However, in the disclosure, the leading surface 31*a* may be provided separately from the fixation unit 20. That is, it is sufficient if the leading surface 31*a* is provided downstream from the transfer unit 50 and upstream from the fixation unit 20.

In the above description, the case has been described in which the conveyance surface 51*a* of the transfer belt 51 is inclined with respect to a horizontal plane (XY plane). However, in the disclosure, the conveyance surface 51*a* of the transfer belt 51 may be horizontal.

In the above description, the case has been described in which the fixation unit 20 includes the fixation belt 21 and the pressure roller 28. However, in the disclosure, another type of fixation unit, for example, a fixation unit having a fixation roller and a pressure roller, may be used.

Effects

As described above, the image formation apparatus 1 according to an embodiment includes: a photosensitive drum 11 (image carrier) configured to carry a developer image; a transfer roller 54 (transfer part) opposed to the photosensitive drum 11; a transfer belt 51 having a conveyance surface 51*a* (a plane) that passes between the photosensitive drum 11 and the transfer roller 54 and faces the photosensitive drum 11 and configured to convey a medium P on the conveyance surface 51*a*; a drive roller 52 and a tension roller 53 on which the transfer belt 51 is stretched; and a separation film 41 (separating member) disposed to face the drive roller 52 (downstream roller) provided on the downstream side of the medium conveyance direction among the rollers and configured to separate the medium P from the transfer belt 51. The separation film 41 includes the guide surface 41*a* to guides the medium P. The guide surface 41*a* is arranged at an angle such that the distance from the guide surface 41*a* to the conveyance reference plane S, which is a virtual plane extending the conveyance surface 51*a*, becomes shorter as proceeding the medium conveyance direction (+Y direction).

According to this configuration, even if the separation timing of the medium P from the transfer belt 51 differs between both widthwise ends of the medium P, the medium P is led along the guide surface 41*a* of the separation film 41 to approach the conveyance reference plane S, so that the difference in the amount of movement of the medium P between both widthwise ends can be reduced. This can suppress the occurrence of torsion of the medium P and suppress the occurrence of printing defects (blurring).

Since the fixation unit 20 includes the leading surface 31*a*, the medium P which has passed through the guide surface 41*a* of the separation film 41 can be led to the fixation nip N through the leading surface 31*a*.

Since the angle A of the guide surface 41*a* with respect to the conveyance reference plane S is smaller than the angle B of the leading surface 31*a* with respect to the conveyance reference plane S (that is, the equation A<B is satisfied), the medium P passing through the guide surface 41*a* can be made to contact the leading surface 31*a* and be smoothly led into the fixation nip N.

Since a part of the leading surface 31*a* is located on the conveyance reference plane S (that is, the leading surface 31 intersects with the conveyance reference plane S), even if the thick medium P such as thick paper is conveyed without contacting the guide surface 41*a*, the medium P can be surely contacted with the leading surface 31*a* and can be smoothly led into the fixation nip N.

Since a part of the leading surface 31*a* is located on the virtual plane T extending the guide surface 41*a* (that is, the leading surface 31*a* intersects with the virtual plane T extending the guide surface 41*a*), the medium P conveyed along the guide surface 41*a* can certainly contact the leading surface 31*a* and be smoothly led to the fixation nip N.

Also, since the separation film 41 formed of resin is easily deformable, the medium P can be efficiently separated from the transfer belt 51.

Since the separation film 41 includes the first protruding portion 411 protruding from the support 42 to the transfer belt 51 side, the medium P attached to the transfer belt 51 can be separated from the transfer belt 51 by the first protruding portion 411.

Since the separation film 41 includes the second protruding portion 412 projecting from the support 42 to the opposite side (fixation unit 20 side) of the transfer belt 51, the deformation of the second protruding portion 412 secures a space in which the medium P can deflect.

In an embodiment described above, the case has been described in which the image formation apparatus forms color images. However, the disclosure can also be applied to an image formation apparatus that forms monochrome (black and white) images. Further, the disclosure can be applied to a fixation unit and an image formation apparatus of various types (for example, a copying machine, a facsimile machine, a printer, a multifunction circumferential, etc.) that forms an image on a medium by using an electrophotographic method.

The invention includes other embodiments or modifications in addition to one or more embodiments and modifications described above without departing from the spirit of the invention. The one or more embodiments and modifications described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

an image carrier configured to carry a developer image;

a transfer part arranged facing the image carrier:

a transfer belt that passes between the image carrier and the transfer part, includes a conveyance surface that is a plane facing the image carrier, and configured to convey a medium on the conveyance surface;

a plurality of rollers to which the transfer belt is stretched, the plurality of rollers including a downstream roller provided on a downstream side in a medium conveyance direction in the plurality of rollers; and a separating member provided facing the downstream roller and configured to separate the medium from the transfer belt, wherein the separating member includes a guide surface to guide the medium, wherein an entirety of the guide surface is arranged on an opposite side of the image carrier with respect to a conveyance reference plane and wherein the entirety of the guide surface including an upstream end portion of the guide surface in the medium conveyance direction is arranged at an angle such that a distance from the guide surface to the conveyance reference plane becomes shorter as proceeding in the medium conveyance direction, the conveyance reference plane being a virtual plane extending the conveyance surface, the separating member comprises a separation film formed of resin, the separation film being supported by a support, the separation film includes at least one of a first protruding portion and a second protruding portion, wherein the first protruding portion protrudes from the support in an upstream direction along the medium conveyance direction such that the first protruding portion is deformable due to a weight of the medium being conveyed on the first protruding portion and the second protruding portion protrudes from the support in a downstream direction along the medium conveyance direction such that the second protruding portion is deformable due to the weight of the medium being conveyed on the second protruding portion, and a downstream edge of the second protruding portion includes: a center region thereof in a longitudinal direction of the separation film substantially orthogonal to the medium conveyance direction; an end region thereof in the longitudinal direction of the separation film, and an intermediate region between the center region and the end region in the longitudinal direction of the separation film, wherein the intermediate region of the downstream edge of the second protruding portion extends linearly in the longitudinal direction of the separation film to the end region.

2. The image formation apparatus according claim 1, further comprising a fixation unit provided downstream of the separating member in the medium conveyance direction, including a fixation nip, and configured to fix the developer image to the medium at the fixation nip, wherein the fixation unit includes a leading surface that leads the medium into the fixation nip.

3. The image formation apparatus according claim 2, wherein the angle of the guide surface with respect to the conveyance reference plane is smaller than an angle of the leading surface with respect to the conveyance reference plane.

4. The image formation apparatus according claim 2, wherein a part of the leading surface is located on the conveyance reference plane.

5. The image formation apparatus according claim 2, wherein a part of the leading surface is located on a virtual plane extending the guide surface.

6. The image formation apparatus according claim 2, wherein the fixation nip and the guide surface are located on opposite sides from each other across the conveyance reference plane.

7. The image formation apparatus according claim 1, wherein the support includes: a support portion facing the conveyance reference plane and supporting the separation film; and an opposing portion extending along the downstream roller.

* * * * *